United States Patent [19]

Nuckel

[11] 3,996,781

[45] Dec. 14, 1976

[54] ROLLING MILLS

[75] Inventor: Norbert Nuckel, Dusseldorf, Germany

[73] Assignee: Firma Friedrich Kocks, Dusseldorf, Germany

[22] Filed: Dec. 3, 1975

[21] Appl. No.: 637,410

[30] Foreign Application Priority Data

Dec. 7, 1974 Germany ..... 2458087

[52] U.S. Cl. ..... 72/221; 72/235

[51] Int. Cl.[2] ..... B21B 31/08; B21B 1/16

[58] Field of Search ..... 72/221, 234, 238, 249, 72/235, 257

[56] References Cited

UNITED STATES PATENTS

| | | | |
|---|---|---|---|
| 1,878,595 | 9/1932 | Moller | 72/235 X |
| 2,089,311 | 8/1937 | Tolles | 72/235 |
| 3,319,449 | 5/1967 | Hill | 72/237 |

*Primary Examiner*—Milton S. Mehr

*Attorney, Agent, or Firm*—Buell, Blenko & Ziesenheim

[57] ABSTRACT

A rolling mill is provided for rolling wire, light sections and tubular products having a fixed rolling axis and a plurality of roll stands arranged directly one behind the other and each of which has two driven work rolls extending parallel to one another and transversely of the rolling direction, said work rolls of each stand defining at least two sizing passes only one of which is located on the rolling axis at one time while the other sizing passes of the stand are interchangeably located away from the rolling axis and act as stand-by passes.

11 Claims, 4 Drawing Figures

ROLLING MILLS

This invention relates to a rolling mill and particularly to a rolling mill for wire, light sections or tubular products, which rolling mill has a fixed rolling axis and comprises a plurality of roller stands which are arranged directly one behind the other and each of which has two driven working rollers which extend parallel to one another and transversely of the rolling direction.

One known rolling mill of this type in the prior art is a single strand rolling mill in which each roller stand has only one sizing pass, so that the rollers have to be reconditioned or changed as soon as the sizing pass has been rendered inadmissibly large by wear.

Rolling mills are also known in which the working rollers of a stand form a plurality of sizing passes which are arranged side by side in a horizontal plane. However, these rolling mills are multi-strand rolling mills in which a plurality of strands of work-material are guided through the rolling mill simultaneously and parallel to one another. The roller axes of all the stands of this rolling mill extend in a horizontal direction. All the sizing passes are used simultaneously during the rolling operation.

The two known rolling mills described above have the disadvantage that the rollers have to be reconditioned or changed when they have been worn to an appropriate extent. This means that, in both cases, the rolling mill has to be shut down and the rollers stands have to be removed from the rolling mill in order to effect the necessary work in a workshop suitable for this purpose. The cost of changing the rollers is high, since the rollers are relatively expensive and a considerable amount of work is involved in removing, fitting, adjusting and grinding the rollers. This also applies, even if not to the same extent, to the reconditioning of the rollers during which the roller material is ground off and is thus also lost.

A feature of the invention is to reduce the abovementioned effort and the associated costs which are conditioned by the natural wear on the rollers.

The present invention provides a rolling mill which has a fixed rolling axis and which comprises a plurality of roller stands which are arranged directly one behind the other and each of which has two driven working rollers which extend parallel to one another and transversely of the rolling direction, the working rollers of each stand defining at least two sizing passes only one of which is disposed in the region of the fixed rolling axis and is used in this location, while other sizing passes of the stands are located away from the rolling axis and act as stand-by sizing passes.

Thus, the rollers do not have to be reconditioned or even changed when the particular sizing pass in use has been worn, it then being possible to use the stand-by sizing pass, so that it is necessary to recondition the rollers only after the stand-by sizing pass has also been worn. Since all the sizing passes of the rollers can be reconditioned several times, a relatively long period of time elapses until they have to be replaced by fresh rollers. The service life of the rollers is at least doubled by virtue of the construction in accordance with the invention. Basically, it is possible to provide not only one stand-by sizing pass but a plurality of stand-by sizing passes which are used one after the other. The time which elapses before it is necessary to recondition or change the rollers is multiplied in accordance with the number of stand-by sizing passes provided on each stand.

In an advantageous embodiment of the invention, the stand-by sizing passes may be installed on the rolling axis by turning round the roller stand through 180°, thus interchanging the entry side and the delivery side of the particular stand. The roller stands can be turned round in this manner in a very short period of time and without any appreciable effort, so that the rolling mill can be put into operation again very rapidly. Appropriate construction and dimensioning of the support and contact surfaces for each roller stand and of the stand bed renders it possible to avoid displacing the roller stand or its roller transversely to the rolling direction for accurate alignment with the rolling axis. For this purpose, the support and contact surfaces are constructed such that the stand-by sizing pass is aligned accurately with the rolling axis after turning round the roller stand and putting it into operation again.

Furthermore, it is possible to install the stand-by sizing passes on the rolling axis by angularly offsetting the roller stands in the plane of the stands which extend transversely to the rolling direction. Here also, the support and contact surfaces of the stand and of the stand bed can be constructed and arranged such that, after pivoting, the particular stand-by sizing pass is accurately aligned with the rolling axis, thus avoiding the complicated matter of displacing the rollers in the stand or even displacing the entire stand relative to the fixed rolling axis.

In the construction in accordance with the invention, the sizing pass in use and the stand-by sizing pass or passes of a stand can, in the first instance, be of identical construction. This will always be preferred when the rolling stand is to continuously roll work material having a constant cross-sectional shape and cross-sectional dimensions, or when at least the cross-sectional shape and cross-sectional dimensions of the work material are maintained for a long period of time. On the other hand, it is also possible to construct the sizing pass in use and the stand-by sizing pass or passes of a stand for different cross-sections of work material, although for the same stand location. The cross-sectional shape and/or the cross-sectional dimensions of the work material would then also be changed at the same time as the stand-by sizing pass is brought into use. Such a change in the rolling program would be effected in a particularly rapid manner and would be advisable particularly when the rolling program has to be changed over more frequently.

In the embodiments of the invention mentioned hitherto, it is assumed that at least two drive sides are provided at each stand location of the rolling mill and/or on each roller stand in order to be able to drive the roller stand in its fresh position after it has been turned round and/or angularly offset. In a rolling mill in which the stands and the stand locations are each provided with only one drive, and in a particularly advantageous embodiment of the invention, the sizing pass in use is constructed for its particular stand location and each stand-by sizing pass is constructed for an adjacent stand location, the work material remaining the same. A construction of this type renders it possible to substantially reduce the cost of the drive and, nevertheless, to plane the stand-by sizing passes on the rolling axis and thus into the position for use by turning round through 180° and/or angularly offsetting in the plane of the stand which extends transversely to the rolling direction. In addition to turning round and angularly offsetting the stand location is then also exchanged for an adjacent stand, the drive side of the roller stand again coinciding with a drive side of the stand bed, and the drive shaft and the output shaft can be coupled to one another. For this purpose, the drive sides of stand locations adjacent to one another are arranged alternately.

The invention will be further described, by way of example, with reference to the accompanying drawings, in which.

Figure 1:
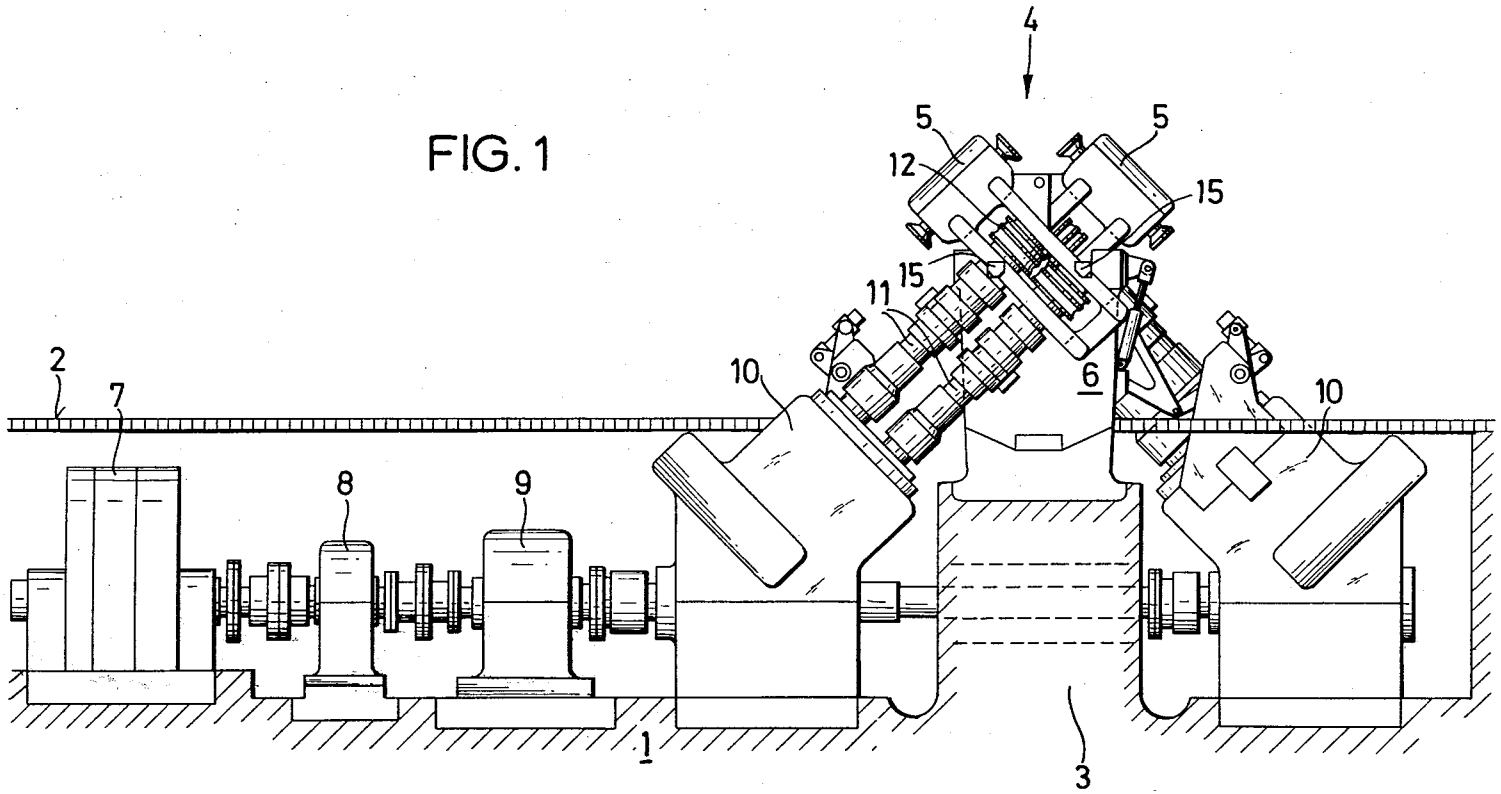
FIG. 1 is a cross section through a two-high single-strand rolling mill of 45° unit construction having a group drive.

Referring to FIG. 1, a foundation 1 is located below the mill floor 2. The single strand rolling mill, generally designated 4, is arranged on a foundation block 3. The rolling mill comprises a number of stands 5 which are arranged directly one behind the other and each of which supports two one-piece rollers 12. The stands 5 are mounted in a common stand bed 6 and are secured thereto so as to be readily releasable.

The rolling mill 4 is driven by an electric motor 7 which drives a cogged cylinder gear (grooved roller gear) or drive gearbox 10 by way of a reduction gearbox 8 and a distributor gearbox 9. The drive gearbox 10 contains bevel gears which permit the drive shafts 11 to extend at an angle of 45° to the horizontal. As may be seen from FIG. 1, the roller stands 5 also slope at an angle of 45° to the horizontal such that the stands 5, arranged one behind the other, are driven alternately by a left-hand drive gearbox 10 and a right-hand drive gearbox 10. Roller stands 5 adjacent to one another are thus arranged so as to lie at an angle of 90° relative to one another.

Figure 2:
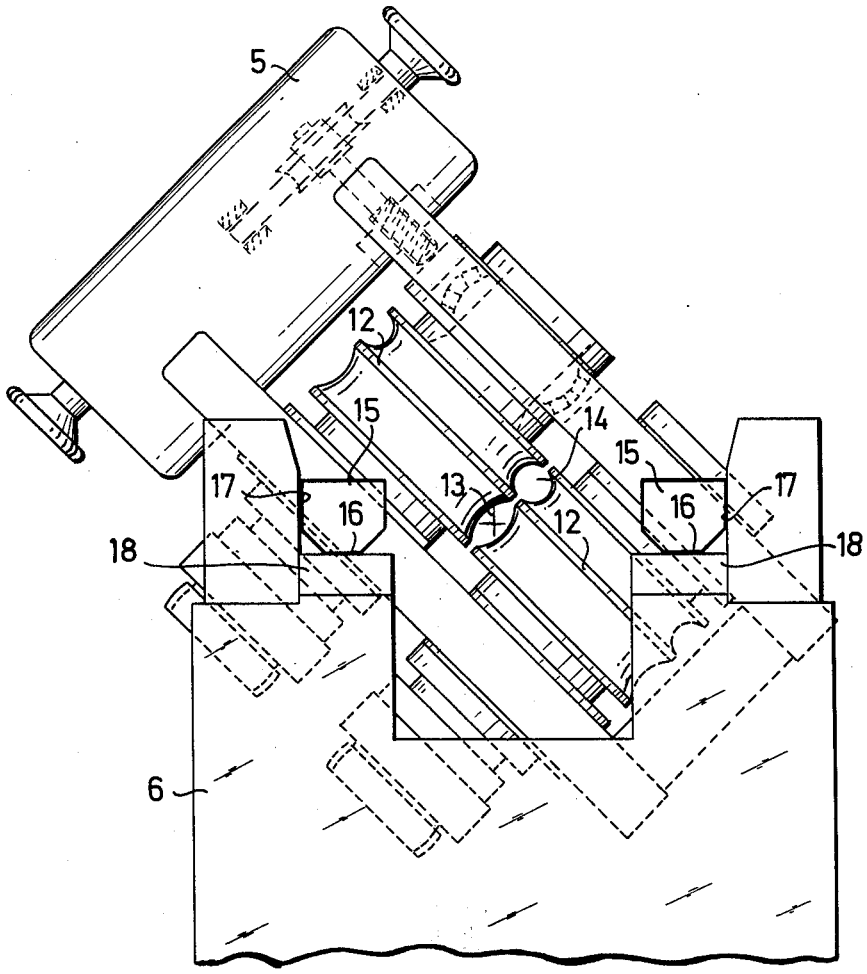
FIG. 2 is a detail view, to a larger scale of the roller stand to be seen in FIG. 1, in a position in which it serves as the first stand.

As may be seen from FIG. 2, the two one-piece rollers 12 form a total of two sizing passes 13 and 14 only one (13) of which is arranged in the region of the rolling axis. In the illustrated embodiment, which is a wire mill, this sizing pass 13 in use has an oval cross section. The work material is guided through a plurality of sizing passes which are arranged directly one behind the other and which have, alternately, an oval and a circular cross-sectional configuration. The other sizing pass 14 has a circular cross section but serves as a stand-by sizing pass which is located outside the rolling axis where it remains unused in the first instance.

The roller stand 5 has support members 15 which are rigidly connected to or preferably integral with the cheeks of the stand. The support members 15 have support faces 16 which are equi-distant from the rolling axis in the case of all the stands 5. They also have lateral contact surfaces 17. The stand bed 6 has complementary counter-surfaces, so that the roller stands 5, and thus the rollers 12 and their sizing passes 13 and 14, are aligned accurately with the rolling axis.

Figure 3:
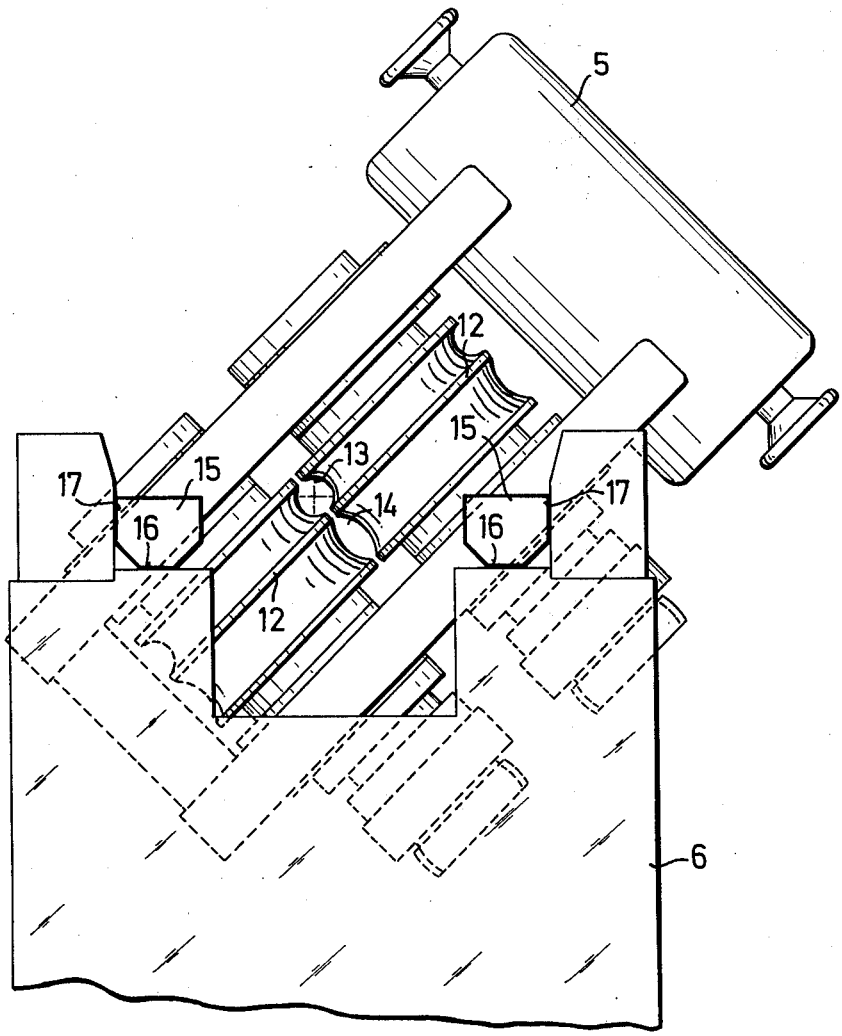
FIG. 3 shows the next roller stand (also visible in FIG. 1) in a position in which it serves as the second stand.

FIG. 3 shows a roller stand 5 which corresponds exactly to the roller stand illustrated in FIG. 2. FIGS. 2 and 3 differ from one another in that they illustrate opposite sides of the stand. Thus FIG. 3 shows the roller stand 5 of FIG. 2 turned through 180°, and owing to the arrangement of the support members 15 on the stand cheeks, the stand 5 as shown in FIG. 3 is angularly offset by 90° relative to the stand shown in FIG. 2. The circular sizing pass is thereby aligned with the rolling in FIG. 3 and has become the sizing pass 13 in use, whereas the oval sizing pass has now become the stand-by sizing pass 14. Of course, at the same time, the position of the drive side of the stand 5 has also changed, as will be clearly seen by comparing FIG. 2 with FIG. 3.

For the reasons stated above, the roller stand 5 can no longer be used at the first stand location when it is arranged in accordance with FIG. 3, since, as may be seen in FIG. 1, the first stand location provides the possibility of drive by the drive shafts 11 only from the bottom left, whereas no drive shafts 11 are provided at the bottom right in the case of stand location 1. However, this applies to the second stand location, so that the roller stand 5 is used at the second stand location when it is in its position shown in FIG. 3. In contrast to FIG. 2, a circular sizing pass is also required at this stand location to provide an alternating sequence of oval and circular sizing passes, which circular sizing pass is also, in fact, aligned accurately with the rolling centre as is shown in FIG. 3, solely due to the fact that the same roller stand 5, which was previously used in the roller location 1 in the position shown in FIG. 2, has now been turned through 180° and thereby angularly offset through 90° and is being used in the second stand location. However, since there is a difference in height between the oval and circular passes due to the inclination of the stand cheeks at 45° to the horizontal the stand bed 6 has support blocks 18 on the first, third and, if required, each further odd-numbered stand location to raise the centres of the oval sizing passes at these stand locations to the level of the rolling axis, while the stand locations 2, 4 and, if required, each further even-numbered stand location, do not have the support blocks 18, as is shown in FIG. 3. The use of support blocks 18 has the advantage that the stand bed 6 can be continuously machined without having to take the individual stand locations into consideration.

Figure 4:
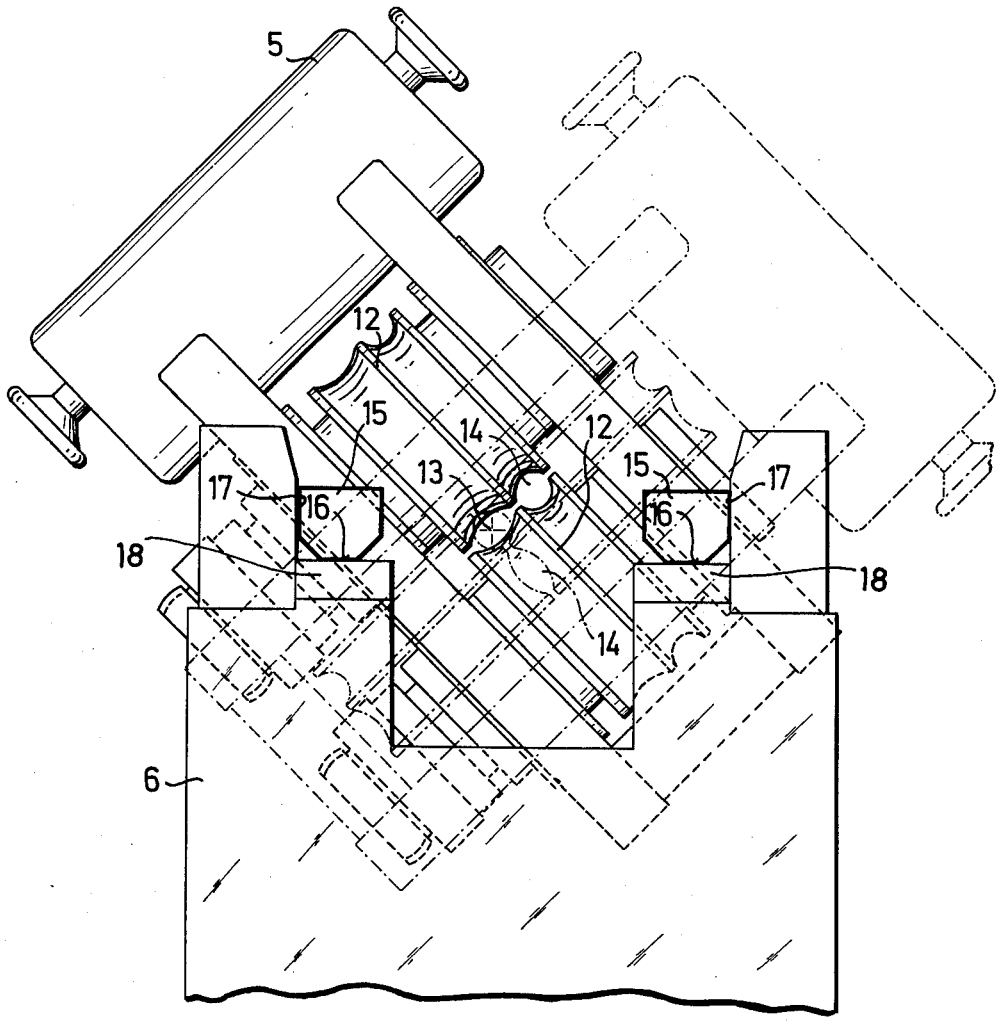
FIG. 4 is a combined illustration of the two stands illustrated in FIGS. 2 and 3.

To provide better comprehension, the stand arrangements illustrated in FIGS. 2 and 3, that is the first and second stand locations, have been shown together in FIG. 4, the first stand location, (shown in FIG. 2), being illustrated by solid lines, whereas the second stand location (shown in FIG. 3) located therebehind is illustrated by broken lines. It will be clearly seen that only the sizing passes 13 in use are aligned with the fixed rolling axis and have alternate oval and circular cross-sectional configurations, whereas the stand-by sizing passes 14 are not only arranged laterally adjacent to the rolling axis but are also arranged alternately below and above the rolling axis, so that they cannot be used in these positions. This is repeated in the following stand locations, wherein the evenly numbered stand locations correspond to one another and the unevenly numbered stand locations correspond to one another.

Analogously, all that which has been described above with reference to a 45° two-high rolling mill for wire can also be applied to other rolling mills, for example to rolling mills in which the roller stands have roller axes which extend alternately horizontally and vertically, and in a rolling mill in which all the roller axes extend only horizontally or vertically. The principle in accordance with the invention can even be used for multi-strand rolling mills having exclusively horizontal roller axes and having exclusively vertical roller axes.

While I have illustrated and described certain preferred embodiments and practices of this invention in the foregoing specification, it will be understood that this invention may be otherwise embodied within the scope of the following claims.

I claim:

1. A rolling mill for wire, light sections and tubular products, which rolling mill has a fixed rolling axis and comprises a plurality of roller stands which are arranged directly one behind the other and each of which has two driven working rollers which extend parallel to one another and transversely of the rolling direction, the working rollers of each stand defining at least two sizing passes only one of which is disposed in the region of the fixed rolling axis and is used in this location, while the other sizing passes of the stands are interchangeably located away from the rolling axis and act as stand-by sizing passes, said roller stands being arranged so that each can be turned round through 180° about an axis perpenducular to the axes of the rollers to place the stand-by sizing passes on the rolling axis, the entry side and the delivery side of each particular stand thus being interchanged.

2. A rolling mill as claimed in claim 1, in which support means are provided whereby the roller stands can be angularly offset in the plane of the stands which extends transversely of the rolling direction to place the stand-by sizing passes on the rolling axis.

3. A rolling mill as claimed in claim 2 wherein the sizing pass in use and the stand-by sizing passes of a stand are of identical construction.

4. A rolling mill as claimed in claim 2 wherein the sizing pass in use and the stand-by sizing passes of a stand are constructed for different cross sections of material but for the same stand location.

5. A rolling mill as claimed in claim 2, in which the roller axes are at 45° to the horizontal.

6. A rolling mill as claimed in claim 5, in which each stand location is provided with only one drive.

7. A rolling mill as claimed in claim 1, in which the sizing pass in use and the stand-by sizing passes of a stand are of identical construction.

8. A rolling mill as claimed in claim 1, in which the sizing pass in use and the stand-by sizing passes of a stand are constructed for different cross sections of the work material but for the same stand location.

9. A rolling mill as claimed in claim 1, in which for each stand the sizing pass in use is constructed for the particular stand location, and the stand-by sizing pass or passes is or are constructed for an adjacent stand location or adjacent stand locations, the work material being of the same cross sections in each case.

10. A rolling mill as claimed in claim 9, in which said stands located adjacent one another are substantially identical to one another and are interchangeable to bring the stand-by passes into use.

11. A rolling mill as claimed in claim 10, in which each stand location is provided with a single drive.

* * * * *